US009875716B2

(12) United States Patent
Moh et al.

(10) Patent No.: US 9,875,716 B2
(45) **Date of Patent: *Jan. 23, 2018**

(54) DISPLAY PANEL WITH A TIMING CONTROLLER EMBEDDED DATA DRIVER AND DISPLAY APPARATUS INCLUDING THE SAME

(71) Applicant: Samsung Display Co., Ltd., Yongin-si (KR)

(72) Inventors: Sang-Moon Moh, Yongin-si (KR); Myeong-Su Kim, Yongin-si (KR); Jin-Ho Park, Yongin-si (KR); Man-Sung Kim, Yongin-si (KR); Dong-Il Seo, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/396,139

(22) Filed: Dec. 30, 2016

(65) Prior Publication Data

US 2017/0110080 A1 Apr. 20, 2017

Related U.S. Application Data

(63) Continuation of application No. 14/519,847, filed on Oct. 21, 2014, now Pat. No. 9,564,106.

(30) Foreign Application Priority Data

Jan. 23, 2014 (KR) ..... 10-2014-0008533

(51) Int. Cl.
*G09G 3/36* (2006.01)

(52) U.S. Cl.
CPC ... *G09G 3/3688* (2013.01); *G09G 2300/0408* (2013.01); *G09G 2310/08* (2013.01); *G09G 2330/021* (2013.01); *G09G 2370/08* (2013.01)

(58) Field of Classification Search
CPC ..... G09G 2310/08; G09G 2310/0264; G09G 3/36–3/3696
See application file for complete search history.

(56) References Cited

U.S. PATENT DOCUMENTS

2006/0077197 A1* 4/2006 Lin ..... G09G 3/3677 345/204
2006/0232579 A1* 10/2006 Chen ..... G09G 3/3611 345/211

(Continued)

FOREIGN PATENT DOCUMENTS

KR 10-0555302 3/2006
KR 10-2006-0121114 11/2006

(Continued)

OTHER PUBLICATIONS

Non-Final Office Action dated Mar. 10, 2016, in U.S. Appl. No. 14/519,847.

(Continued)

*Primary Examiner* — Sanghyuk Park
(74) *Attorney, Agent, or Firm* — H.C. Park & Associates, PLC

(57) ABSTRACT

A display panel includes a timing controller embedded data driver and a first data driver. The timing controller embedded data driver includes an image processing part and an internal data driving part. The image processing part generates a first data signal corresponding to a first display area and a second data signal corresponding to a second display area based on input image data. The internal data driving part generates a second data voltage based on the second data signal to output the second data voltage to the second display area. The first data driver is disposed at a first side of the timing controller embedded data driver. The first data driver receives the first data signal from the timing controller (Continued)

embedded data driver and generates a first data voltage based on the first data signal to output the first data voltage to the first display area.

10 Claims, 6 Drawing Sheets

(56) References Cited

U.S. PATENT DOCUMENTS

| | | | | |
|---|---|---|---|---|
| 2012/0086681 | A1 | 4/2012 | Kim et al. | |
| 2012/0127145 | A1 | 5/2012 | Jang et al. | |
| 2012/0154454 | A1 | 6/2012 | Ohishi | |
| 2012/0223927 | A1* | 9/2012 | Hsieh | G09G 3/36 345/211 |
| 2013/0038597 | A1 | 2/2013 | Kirn et al. | |

FOREIGN PATENT DOCUMENTS

| | | |
|---|---|---|
| KR | 10-0759981 | 9/2007 |
| KR | 10-2011-0122615 | 11/2011 |
| KR | 10-1125471 | 3/2012 |
| KR | 10-1193219 | 10/2012 |

OTHER PUBLICATIONS

Notice of Allowance dated Sep. 23, 2016, in U.S. Appl. No. 14/519,847.

* cited by examiner

DISPLAY PANEL WITH A TIMING CONTROLLER EMBEDDED DATA DRIVER AND DISPLAY APPARATUS INCLUDING THE SAME

CROSS-REFERENCE TO RELATED APPLICATION

This application is a continuation of U.S. patent application Ser. No. 14/519,847, filed on Oct. 21, 2014, and claims priority from and the benefit under 35 U.S.C. §119(a) of Korean Patent Application No. 10-2014-0008533, filed on Jan. 23, 2014, the entire disclosure of which is incorporated herein by reference for all purposes.

BACKGROUND

Field

The following disclosure relates to a display panel, more particularly, a display panel with decreased thickness and power consumption.

Discussion of the Background

Generally, a liquid crystal display ("LCD") apparatus includes a first substrate including a pixel electrode, a second substrate including a common electrode, and a liquid crystal layer disposed between the first substrate and the second substrate. An electric field is generated by voltages applied to the pixel electrode and the common electrode. By adjusting an intensity of the electric field, a transmittance of a light passing through the liquid crystal layer may be adjusted so that a desired image may be displayed.

The liquid crystal display apparatus includes a display panel and a panel driver driving the display panel. The panel driver includes a timing controller, a gate driver, and a data driver.

Generally, the timing controller is disposed on a printed circuit board ("PCB") and is connected to the display panel through a flexible printed circuit board ("FPC"). The printed circuit board may be disposed on a rear surface of the display panel.

Due to the printed circuit board, a thickness of the display apparatus may increase. In addition, due to a signal transmission between the timing controller and the data driver, power consumption may increase.

SUMMARY

Exemplary embodiments of the present invention provide a more energy efficient display panel with decreased thickness.

Exemplary embodiments of the present invention also provide a display apparatus including the more energy efficient display panel with decreased thickness.

Exemplary embodiments of the present invention provide a display panel including a timing controller embedded data driver, and a first data driver. The timing controller embedded data driver includes an image processing part and an internal data driving part. The image processing part generates a first data signal corresponding to a first display area and a second data signal corresponding to a second display area based on input image data. The internal data driving part generates a second data voltage based on the second data signal to output the second data voltage to the second display area. The first data driver is disposed at a first side of the timing controller embedded data driver. The first data driver receives the first data signal from the timing controller embedded data driver and generates a first data voltage based on the first data signal to output the first data voltage to the first display area.

According to aspects of the invention, the image processing part may generate a third data signal corresponding to a third display area based on the input image data. The display panel may further include a second data driver disposed at a second side of the timing controller embedded data driver opposite to the first side. The second data driver may be configured to receive the third data signal from the timing controller embedded data driver and to generate a third data voltage based on the third data signal to output the third data voltage to the third display area.

According to aspects of the invention, the timing controller embedded data driver may include a signal generating part configured to generate a first gate control signal based on an input control signal and a level shifter configured to adjust a level of the first gate control signal to generate a second gate control signal.

According to aspects of the invention, the display panel may further include a gate driver disposed adjacent to the first display area and configured to output a gate signal to the first and second display areas.

According to aspects of the invention, the timing controller embedded data driver may directly output the second gate control signal to the gate driver.

According to aspects of the invention, the timing controller embedded data driver may transmit the second gate control signal to the first data driver. The first data driver may output the second gate control signal to the gate driver.

According to aspects of the invention, the gate driver may be integrated on a substrate of the display panel.

According to aspects of the invention, the timing controller embedded data driver may be formed as a first chip. The first data driver may be formed as a second chip, the second chip spaced apart from the first chip.

According to aspects of the invention, the first chip and the second chip may be mounted on a substrate of the display panel.

Exemplary embodiments of the present invention provide a display apparatus including a display panel and a flexible printed circuit board. The display panel a timing controller embedded data driver and a first data driver. The timing controller embedded data driver includes an image processing part and an internal data driving part. The image processing part generates a first data signal corresponding to a first display area and a second data signal corresponding to a second display area based on input image data. The internal data driving part generates a second data voltage based on the second data signal to output the second data voltage to the second display area. The first data driver is disposed at a first side of the timing controller embedded data driver. The first data driver receives the first data signal from the timing controller embedded data driver and generates a first data voltage based on the first data signal to output the first data voltage to the first display area. The flexible printed circuit board is connected to the display panel. The flexible printed circuit board includes a connector configured to transmit the input image data to the timing controller embedded data driver and a voltage generator configured to provide power voltages to the timing controller embedded data driver and the first data driver.

According to aspects of the invention, the image processing part may generate a third data signal corresponding to a third display area based on the input image data. The display panel may further include a second data driver disposed at a second side of the timing controller embedded data driver opposite to the first side. The second data driver may be configured to receive the third data signal from the timing controller embedded data driver and to generate a third data voltage based on the third data signal to output the third data voltage to the third display area.

According to aspects of the invention, the timing controller embedded data driver may include a signal generating part configured to generate a first gate control signal based on an input control signal and a level shifter configured to adjust a level of the first gate control signal to generate a second gate control signal.

According to aspects of the invention, the display panel may further include a gate driver disposed adjacent to the first display area and configured to output a gate signal to the first and second display areas.

According to aspects of the invention, the timing controller embedded data driver may directly output the second gate control signal to the gate driver.

According to aspects of the invention, the timing controller embedded data driver may transmit the second gate control signal to the first data driver. The first data driver may output the second gate control signal to the gate driver.

According to aspects of the invention, the gate driver may be integrated on a substrate of the display panel.

According to aspects of the invention, the timing controller embedded data driver may include a signal generating part configured to generate a first gate control signal based on an input control signal. The flexible printed circuit board may further include a level shifter configured to adjust a level of the first gate control signal to generate a second gate control signal.

According to aspects of the invention, the timing controller embedded data driver may be formed as a first chip. The first data driver may be formed as a second chip, the second chip spaced apart from the first chip.

According to aspects of the invention, the first chip and the second chip may be mounted on a substrate of the display panel.

Exemplary embodiments of the present invention provide a display panel and a display apparatus including the same. The display panel includes a timing controller embedded data driver, which operates functions of a timing controller and a data driver so that a printed circuit board may be omitted and thickness of the display apparatus may be decreased. In addition, the timing controller embedded data driver includes the timing controller and an internal data driving part so that a power consumption of a signal transmission may decrease compared to a signal transmission between the timing controller and an external data driver.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
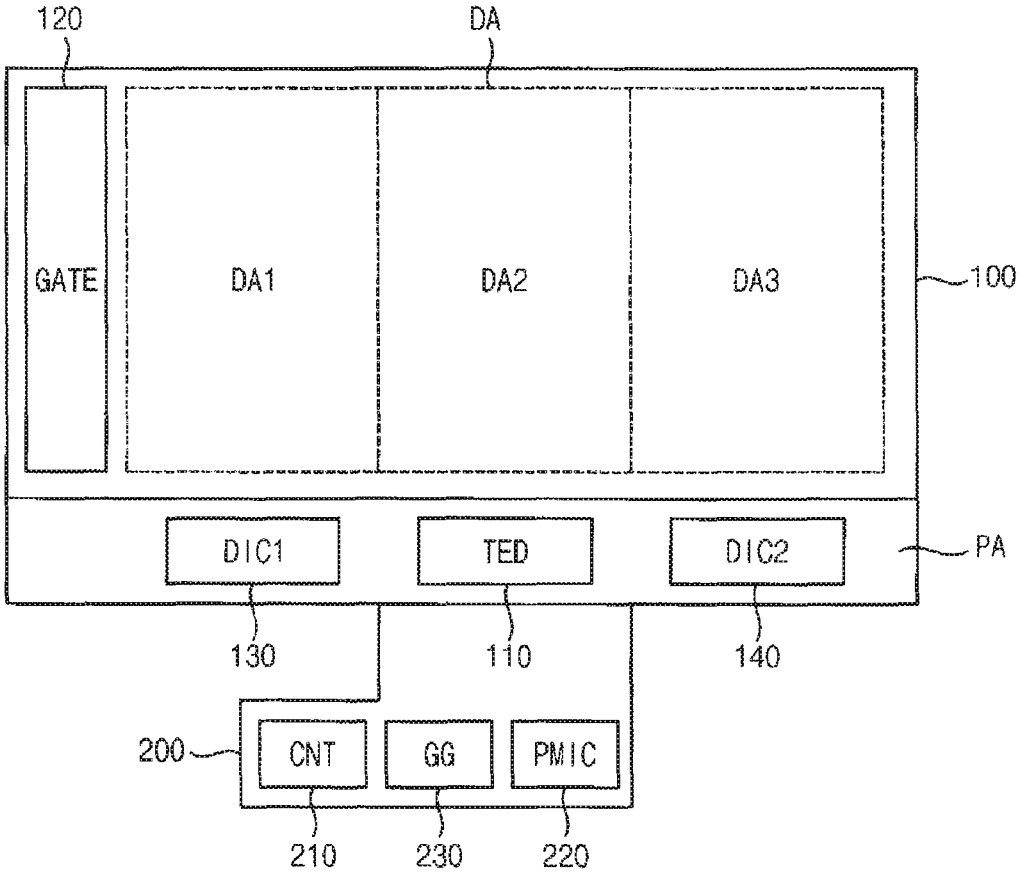
FIG. 1 is a plan view illustrating a display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. It will be understood that for the purposes of this disclosure, "at least one of X, Y, and Z" can be construed as X only, Y only, Z only, or any combination of two or more items X, Y, and Z (e.g., XYZ, XZ, XYY, YZ, ZZ). Throughout the drawings and the detailed description, unless otherwise described, the same drawing reference numerals are understood to refer to the same elements, features, and structures. The relative size and depiction of these elements may be exaggerated for clarity.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Although some features may be described with respect to individual exemplary embodiments, aspects need not be limited thereto such that features from one or more exemplary embodiments may be combinable with other features from one or more exemplary embodiments.

FIG. 1 is a plan view illustrating a display apparatus according to an exemplary embodiment of the present invention.

Referring to FIG. 1, the display apparatus includes a display panel 100 and a flexible printed circuit board 200.

The display panel 100 includes a display area DA displaying an image and a peripheral area PA disposed adjacent to the display area DA. The display panel 100 includes a first display area DA1, a second display area DA2, and a third display area DA3.

The display panel 100 may include a plurality of gate lines, a plurality of data lines, and a plurality of pixels connected to the gate lines and the data lines. At least one of the gate lines may extend in a first direction and at least one of the data lines may extend in a second direction crossing the first direction.

According to aspects of the invention, at least one of the pixels may include a switching element, a liquid crystal capacitor, and a storage capacitor. The liquid crystal capacitor and the storage capacitor may be electrically connected to the switching element. The unit pixels may be disposed in a matrix form.

The display panel 100 includes a timing controller embedded data driver 110 (TED), a gate driver 120 (GATE), a first data driver 130 (DIC1), and a second data driver 140 (DIC2). The timing controller embedded data driver 110, the gate driver 120, the first data driver 130, and the second data driver 140 are formed, disposed, or configured in the peripheral area PA of the display panel 100.

The first data driver 130 may be disposed at a first side of the timing controller embedded data driver 110. The second data driver 140 may be disposed at a second side of the timing controller embedded data driver 110, which may be opposite to or across from the first side.

For example, the gate driver 120 may be integrated or disposed on a substrate of the display panel 100. Alternatively, the gate driver 120 may be formed, disposed, or configured outside of the display panel 100 and be connected to the display panel 100.

For example, at least one of the timing controller embedded data driver 110, the first data driver 130, and the second data driver 140 may have chip types. The timing controller embedded data driver 110, the first data driver 130, and the second data driver 140 may be spaced apart from one another. The timing controller embedded data driver 110, the first data driver 130, and the second data driver 140 may be mounted on the substrate of the display panel 100.

However, aspects of the invention are not limited thereto, such that the timing controller embedded data driver 110, the first data driver 130, and the second data driver 140 may be formed, disposed, or configured outside of the display panel 100 and be connected to the display panel 100.

The flexible printed circuit board 200 includes a connector 210 (CNT) and a voltage generator 220 (PMIC). The flexible printed circuit board 200 may further include a gamma reference voltage generator 230 (GG).

The connector 210 may receive an input signal from an external apparatus and transmit the input signal to the timing controller embedded data driver 110. For example, the input signal may receive the input signal from a set board.

The voltage generator 220 may generate a power voltage to drive the display panel 100. For example, the voltage generator 220 may generate at least one of an analog AVDD voltage, a digital DVDD voltage, a gate on voltage, a gate off voltage, and a common voltage.

The voltage generator 220 may output the power voltage to at least one of the timing controller embedded data driver 110, the gate driver 120, the first data driver 130, and the second data driver 140 of the display panel 100. The voltage generator 220 may output the common voltage to a common electrode of the display panel 100.

The gamma reference voltage generator 230 generates a gamma reference voltage using the power voltage of the voltage generator 220. The gamma reference voltage generator 230 outputs the gamma reference voltage to at least one of the timing controller embedded data driver 110, the first data driver 130, and the second data driver 140.

For example, the gamma reference voltage may be a digital gamma reference voltage. However, aspects of the invention are not limited thereto, such that the gamma reference voltage may be an analog gamma reference voltage.

Unlike FIG. 1, the gamma reference voltage generator 230 may be formed, disposed, or configured in the timing controller embedded data driver 110.

Figure 2:
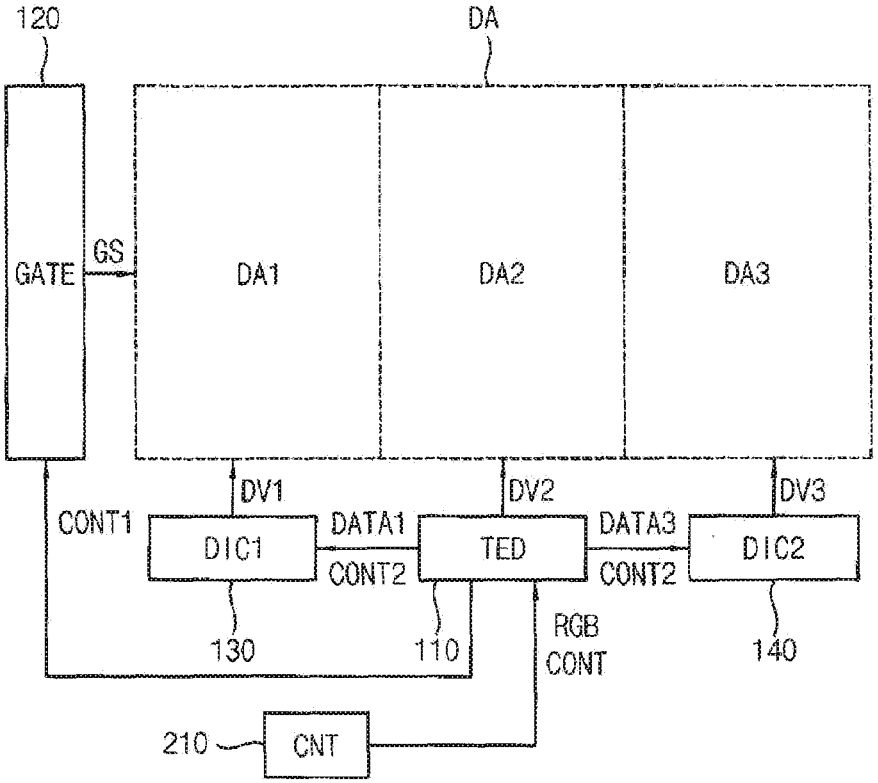
FIG. 2 is a block diagram illustrating the display apparatus of FIG. 1.
Figure 3:
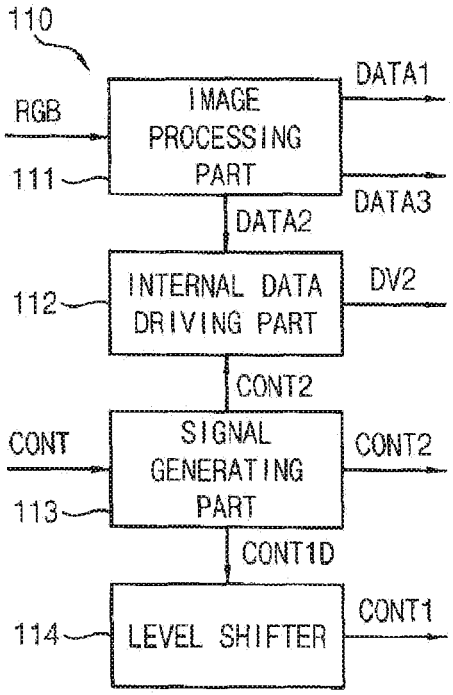
FIG. 3 is a block diagram illustrating a timing controller embedded data driver of FIG. 1.

FIG. 2 is a block diagram illustrating the display apparatus of FIG. 1. FIG. 3 is a block diagram illustrating the timing controller embedded data driver of FIG. 1.

Referring to FIG. 1, FIG. 2, and FIG. 3, the connector 210 may receive input image data RGB and an input control signal CONT from an external apparatus. The connector 210 may output or transmit the input image data RGB and the input control signal CONT to the timing controller embedded data driver 110.

The timing controller embedded data driver 110 may function or operate as a timing controller, which generates control signals to control a driving timing of at least one of the gate driver 120, the first data driver 130, and the second data driver 140. In addition, the timing controller embedded data driver 110 may function as a data driver, which outputs a data voltage to the display panel 100.

The first data driver 130 and the second data driver 140 may function or operate as the data driver. The first data driver 130 and the second data driver 140 may receive a data signal and the control signal from the timing controller embedded data driver 110, and may output the data voltage to the display panel 100.

The timing controller embedded data driver 110 includes an image processing part 111, an internal data driving part 112, a signal generating part 113, and a level shifter 114.

The image processing part 111 may receive the input image data RGB from the connector 210. The input image data RGB may include grayscale data corresponding to some or all of the first display area DA1, the second display area DA2, and the third display area DA3 of the display panel 100.

The image processing part 111 may rearrange the input image data RGB to generate a data signal corresponding to a structure of the display panel 100. In addition, the image processing part 111 may divide the data signal to correspond to the first display area DA1, the second display area DA2, and the third display area DA3.

The image processing part 111 may generate a first data signal DATA1 corresponding to the first display area DA1 based on the input image data RGB, and may output the first data signal DATA1 to the first data driver 130. For example, the first data signal DATA1 may be a digital type data signal.

The image processing part 111 may generate a second data signal DATA2 corresponding to the second display area DA2 based on the input image data RGB, and may output the second data signal DATA2 to the internal data driving part 112. For example, the second data signal DATA2 may be a digital type data signal.

The image processing part 111 may generate a third data signal DATA3 corresponding to the third display area DA3 based on the input image data RGB, and may output the third data signal DATA3 to the second data driver 140. For example, the third data signal DATA3 may be a digital type data signal.

For example, the image processing part 111 may compensate a grayscale of the input image data RGB. According to aspects of the invention, the image processing part 111 may include an adaptive color correcting part and a dynamic capacitance compensating part.

The adaptive color correcting part may receive the grayscale data of the input image data RGB, and may perform an adaptive color correction ("ACC") operation. The adaptive color correcting part may compensate the grayscale data using a gamma curve.

The dynamic capacitance compensating part may perform a dynamic capacitance compensation ("DCC") operation. DCC operation may compensate the grayscale data of present frame data using previous frame data and the present frame data.

The internal data driving part 112 may receive the second data signal DATA2 from the image processing part 111. The internal data driving part 112 may receive a data control signal CONT2 from the signal generating part 113.

The internal data driving part 112 may generate a second data voltage DV2 based on the second data signal DATA2 in response to the data control signal CONT2. The internal data driving part 112 may output or transmit the second data voltage DV2 to the second display area DA2. For example, the second data voltage DV2 may be an analog type data voltage.

The internal data driving part 112 may include at least one of a shift register, a latch, a digital to analog convertor, and a buffer.

The internal data driving part 112 may operate one or more functions substantially similar or the same as the first data driver 130 and the second data driver 140.

The signal generating part 113 may receive the input control signal CONT from the connector 210. The signal generating part 113 may generate a first gate control signal CONT1D to control a driving timing of the gate driver 120 based on the input control signal CONT. The signal generating part 113 may generate a data control signal CONT2 to control driving timings of at least one of the internal data driving part 112, the first data driver 130, and the second data driver 140 based on the input control signal CONT.

The signal generating part 113 may output the first gate control signal CONT1D to the level shifter 114. The signal generating part 113 may output the data control signal CONT2 to the internal data driving part 112, the first data driver 130, and the second data driver 140. For example, the data control signal CONT2 may include at least one of a vertical start signal and a load signal.

The level shifter 114 may receive the first gate control signal CONT1D from the signal generating part 113. The level shifter 114 may adjust a level of the first gate control signal CONT1D to generate a second gate control signal CONT1. A level of the second gate control signal CONT1 may be greater than the level of the first gate control signal CONT1D.

The level shifter 114 may directly output the second gate control signal CONT1 to the gate driver 120. For example, the second gate control signal CONT1 may include a vertical start signal and a gate clock signal.

For example, when a size of the display panel 100 is relatively small or below a reference size, it may be more efficient that the timing controller embedded data driver 110 to generate the second gate control signal CONT1. Thus, the level shifter 114 may be included in the timing controller embedded data driver 110.

The gate driver 120 may receive the second gate control signal CONT1 from the level shifter 114. The gate driver 120 may generate gate signals GS to drive the gate lines of the display area DA in response to the second gate control signal CONT1.

The gate driver 120 may sequentially output the gate signals GS to the gate lines.

The first data driver 130 may receive the first data signal DATA1 from the image processing part 111. The first data driver 130 may receive the data control signal CONT2 from the signal generating part 113.

The first data driver 130 may generate a first data voltage DV1 based on the first data signal DATA1 in response to the data control signal CONT2. The first data driver 130 may output the first data voltage DV1 to the first display area DA1. For example, the first data voltage DV1 may have an analog type.

The first data driver 130 may include at least one of a shift register, a latch, a digital to analog converter, and a buffer.

The second data driver 140 may receive the third data signal DATA3 from the image processing part 111. The second data driver 140 may receive the data control signal CONT2 from the signal generating part 113.

The second data driver 140 may generate a third data voltage DV3 based on the third data signal DATA3 in response to the data control signal CONT2. The second data driver 140 may output the third data voltage DV3 to the third display area DA3. For example, the third data voltage DV3 may be an analog type data voltage.

The second data driver 140 may include at least one of a shift register, a latch, a digital to analog converter, and a buffer.

Although the display panel 100 is described as including one timing controller embedded data driver and two normal data drivers, which may not function as a timing controller, aspects of the invention are not limited thereto. For example, the display panel may include one timing controller embedded data driver and one normal data driver. Further, the display panel may include one timing controller embedded data driver and three or more normal data drivers.

Although the display panel 100 is described as including one gate driver 120 adjacent to the first display area DA1, aspects of the invention are not limited thereto. For example, the display panel 100 may include the first gate driver 120 adjacent to the first display area DA1 and a second gate driver adjacent to the third display area DA3.

According to aspects of the invention, the display panel 100 may include the timing controller embedded data driver 110, which may function as both the timing controller and the data driver, such that a printed circuit board to mount the timing controller may be omitted. Thus, a thickness of the display apparatus may be decreased.

In addition, the image processing part 111 and the internal data driver 112 may be formed or configured as a single chip, such that power consumption for a signal transmission may be decreased in comparison to a signal transmission between the timing controller and an external data driver.

In addition, the data signal corresponding to the first display area DA1, the data signal corresponding to the second display area DA2, and the data signal corresponding to the third display area DA3 may be divided in the timing controller embedded data driver 110. Accordingly, a set board may not be required to provide divided input image data for at least one of the first display area DA1, the second display area DA2, and the third display area DA3. Thus, compatibility to a normal set board may be more likely or guaranteed.

Figure 4:
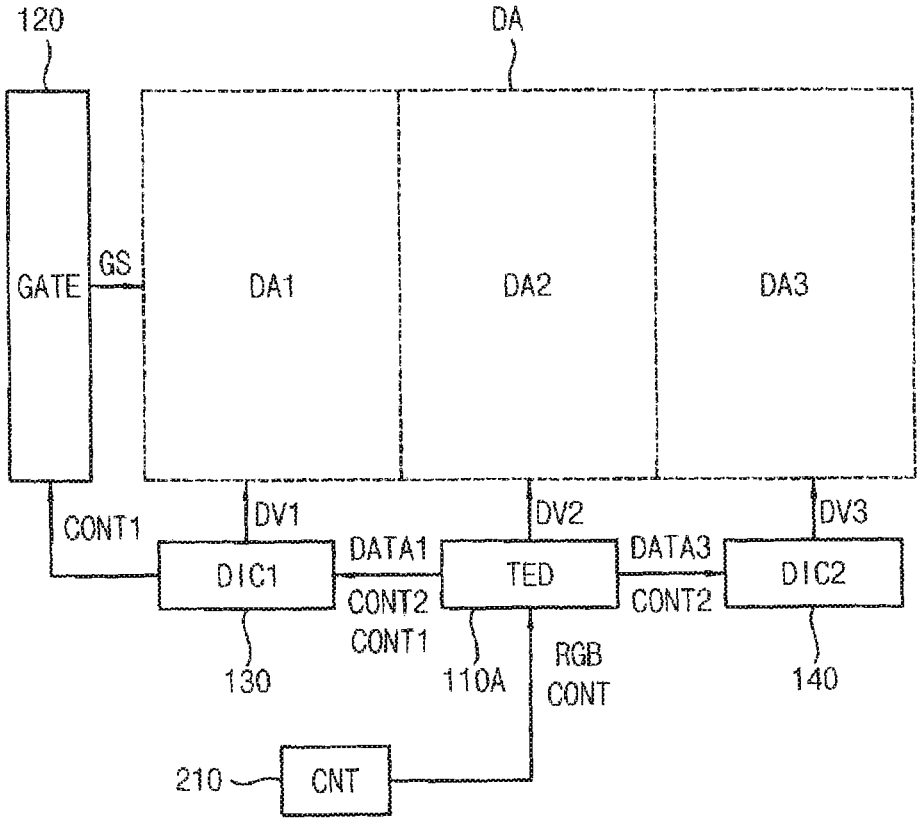
FIG. 4 is a block diagram illustrating a display apparatus according to an exemplary embodiment of the present invention.

FIG. 4 is a block diagram illustrating a display apparatus according to an exemplary embodiment of the present invention.

The display apparatus of FIG. 4 may be substantially similar or the same as the display apparatus of FIG. 1, FIG. 2, and FIG. 3 except for a control signal path from the timing controller embedded data driver to the gate driver. Thus, the same reference numerals may be used to refer to the same or like parts as those described in the previous exemplary embodiment of FIG. 1, FIG. 2, and FIG. 3 and any repetitive explanation concerning the above elements will be omitted.

Referring to FIG. 1, FIG. 3 and FIG. 4, the display apparatus includes the display apparatus includes a display panel 100 and a flexible printed circuit board 200.

The display panel 100 includes a timing controller embedded data driver 110A, a gate driver 120, a first data driver 130, and a second data driver 140.

The flexible printed circuit board 200 includes a connector 210 and a voltage generator 220. The flexible printed circuit board 200 may further include a gamma reference voltage generator 230.

The timing controller embedded data driver 110A includes an image processing part 111, an internal data driving part 112, a signal generating part 113, and a level shifter 114.

The signal generating part 113 may receive the input control signal CONT from the connector 210. The signal generating part 113 may generate a first gate control signal CONT1D to control a driving timing of the gate driver 120 based on the input control signal CONT. The signal generating part 113 may generate a data control signal CONT2 to control driving timings of the internal data driving part 112, the first data driver 130, and the second data driver 140 based on the input control signal CONT.

The signal generating part 113 may output the first gate control signal CONT1D to the level shifter 114. The signal generating part 113 may output the data control signal CONT2 to at least one of the internal data driving part 112, the first data driver 130, and the second data driver 140.

The level shifter 114 may receive the first gate control signal CONT1D from the signal generating part 113. The level shifter 114 may adjust a level of the first gate control signal CONT1D to generate a second gate control signal CONT1.

The level shifter 114 may transmit the second gate control signal CONT1 to the first data driver 130.

The first data driver 130 may output the second gate control signal CONT1 to the gate driver 120. The first data driver 130 may include a transmission path to transmit the second gate control signal CONT1 to the gate driver 120.

According to aspects of the invention, the display panel 100 includes the timing controller embedded data driver 110A, which may function as both the timing controller and the data driver, such that a printed circuit board to mount the timing controller may be omitted. Thus, a thickness of the display apparatus may be decreased.

In addition, the image processing part 111 and the internal data driver 112 may be formed or configured in a single chip so that a power consumption of a signal transmission may be decreased in comparison to a signal transmission between the timing controller and an external data driver.

In addition, the data signal corresponding to the first display area DA1, the data signal corresponding to the second display area DA2, and the data signal corresponding to the third display area DA3 may be divided in the timing controller embedded data driver 110A so that a set board may not required to provide divided input image data for the first display area DA1, the second display area DA2, and the third display area and DA3. Thus, compatibility to a normal set board may be increased or guaranteed.

Figure 5:
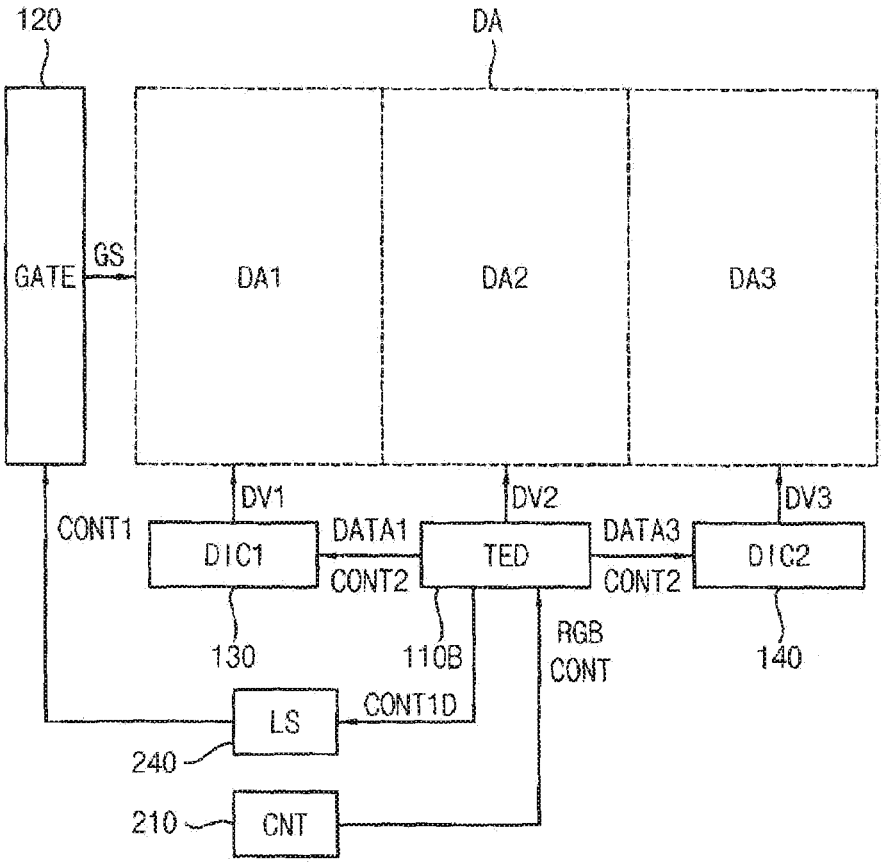
FIG. 5 is a block diagram illustrating a display apparatus according to an exemplary embodiment of the present invention.
Figure 6:
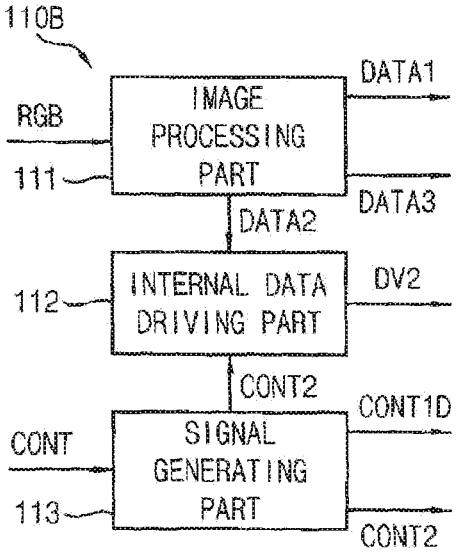
FIG. 6 is a block diagram illustrating a timing controller of FIG. 5.

FIG. 5 is a block diagram illustrating a display apparatus according to an exemplary embodiment of the present invention. FIG. 6 is a block diagram illustrating a timing controller of FIG. 5.

The display apparatus of FIG. 5 and FIG. 6 may be substantially similar to or the same as the display apparatus of FIG. 1, FIG. 2, and FIG. 3 except that the flexible printed circuit board 200 includes a level shifter. Thus, the same reference numerals will be used to refer to the same or like parts as those described in FIG. 1, FIG. 2, and FIG. 3 and any repetitive explanation concerning the above elements may be omitted.

Referring to FIG. 1, FIG. 5 and FIG. 6, the display apparatus includes a display panel 100 and a flexible printed circuit board 200.

The display panel 100 includes a timing controller embedded data driver 110B, a gate driver 120, a first data driver 130, and a second data driver 140.

The flexible printed circuit board 200 includes a connector 210 and a voltage generator 220. The flexible printed circuit board 200 may further include a gamma reference voltage generator 230. The flexible printed circuit board 200 further includes a level shifter 240 (LS).

The timing controller embedded data driver 110B includes an image processing part 111, an internal data driving part 112, and a signal generating part 113.

The signal generating part 113 may receive the input control signal CONT from the connector 210. The signal generating part 113 may generate a first gate control signal CONT1D to control a driving timing of the gate driver 120 based on the input control signal CONT. The signal generating part 113 may generate a data control signal CONT2 to control driving timings of at least one of the internal data driving part 112, the first data driver 130, and the second data driver 140 based on the input control signal CONT.

The signal generating part 113 may output the first gate control signal CONT1D to the level shifter 240, which may be formed or disposed on the flexible printed circuit board 200. The signal generating part 113 may output or transmit the data control signal CONT2 to the internal data driving part 112, the first data driver 130, and the second data driver 140.

The level shifter 240 may receive the first gate control signal CONT1D from the signal generating part 113. The level shifter 240 may adjust a level of the first gate control signal CONT1D to generate a second gate control signal CONT1.

The level shifter 240 may output the second gate control signal CONT1 to the gate driver 120.

For example, when a size of the display panel 100 is relatively great or above a reference value, it may not be as efficient for the timing controller embedded data driver 110B to generate the second gate control signal CONT1. Thus, the level shifter 240 may be included in the flexible printed circuit board 200.

According to aspects of the invention, the display panel 100 includes the timing controller embedded data driver 110B, which may function as both the timing controller and the data driver such that a printed circuit board to mount the timing controller may be omitted. Thus, a thickness of the display apparatus may be decreased.

In addition, the image processing part 111 and the internal data driver 112 may be formed or configured in a single chip so that a power consumption of a signal transmission may be decreased in comparison to a signal transmission between the timing controller and an external data driver.

In addition, the data signal corresponding to the first display area DA1, the data signal corresponding to the second display area DA2 and the data signal corresponding to the third display area DA3 may be divided in the timing controller embedded data driver 110B so that a set board may not required to provide divided input image data for the first display area DA1, the second display area DA2, and the third display area DA3. Thus, compatibility to a normal set board may be increased or guaranteed.

Figure 7:
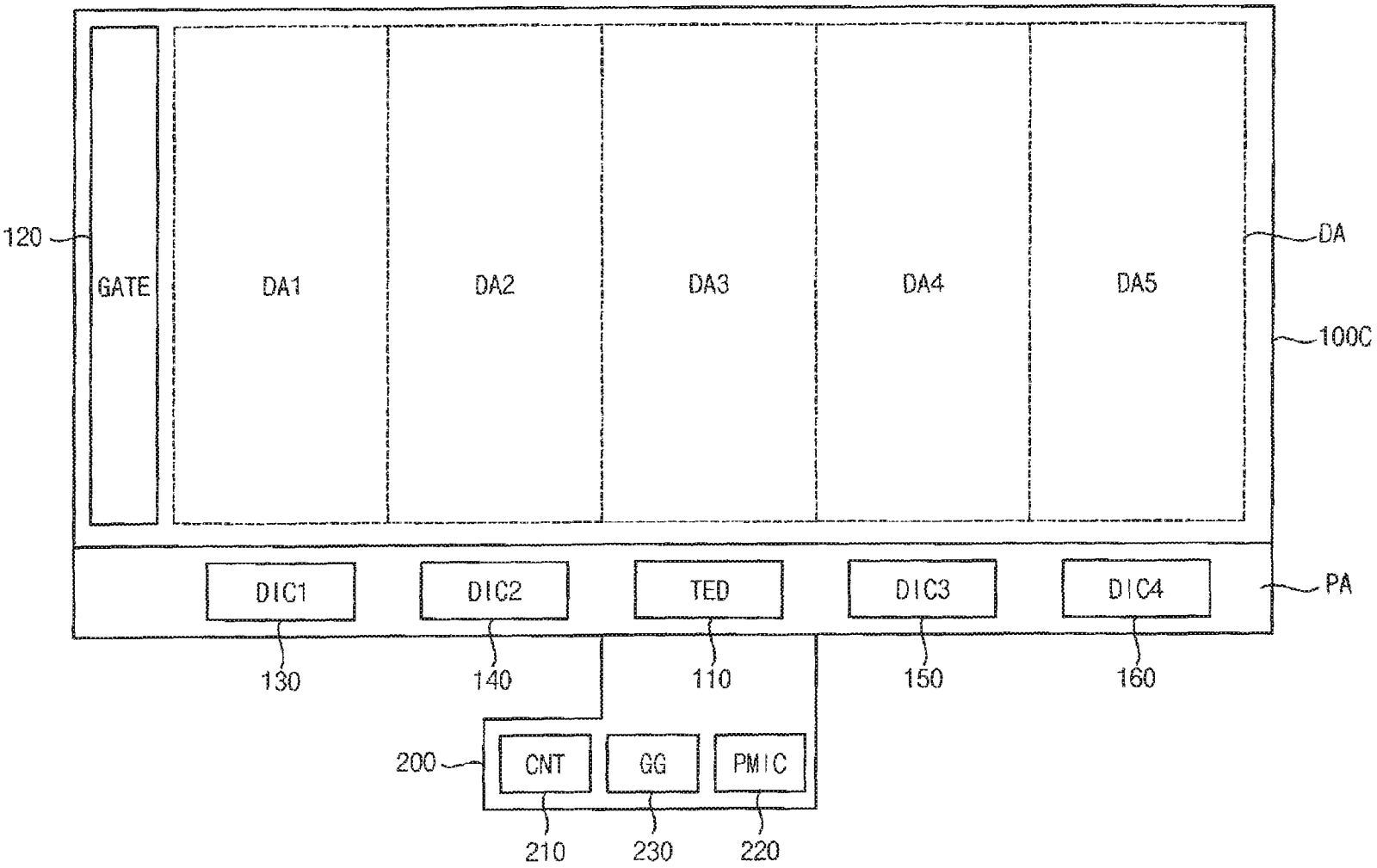
FIG. 7 is a plan view illustrating a display apparatus according to an exemplary embodiment of the present invention.
Figure 8:
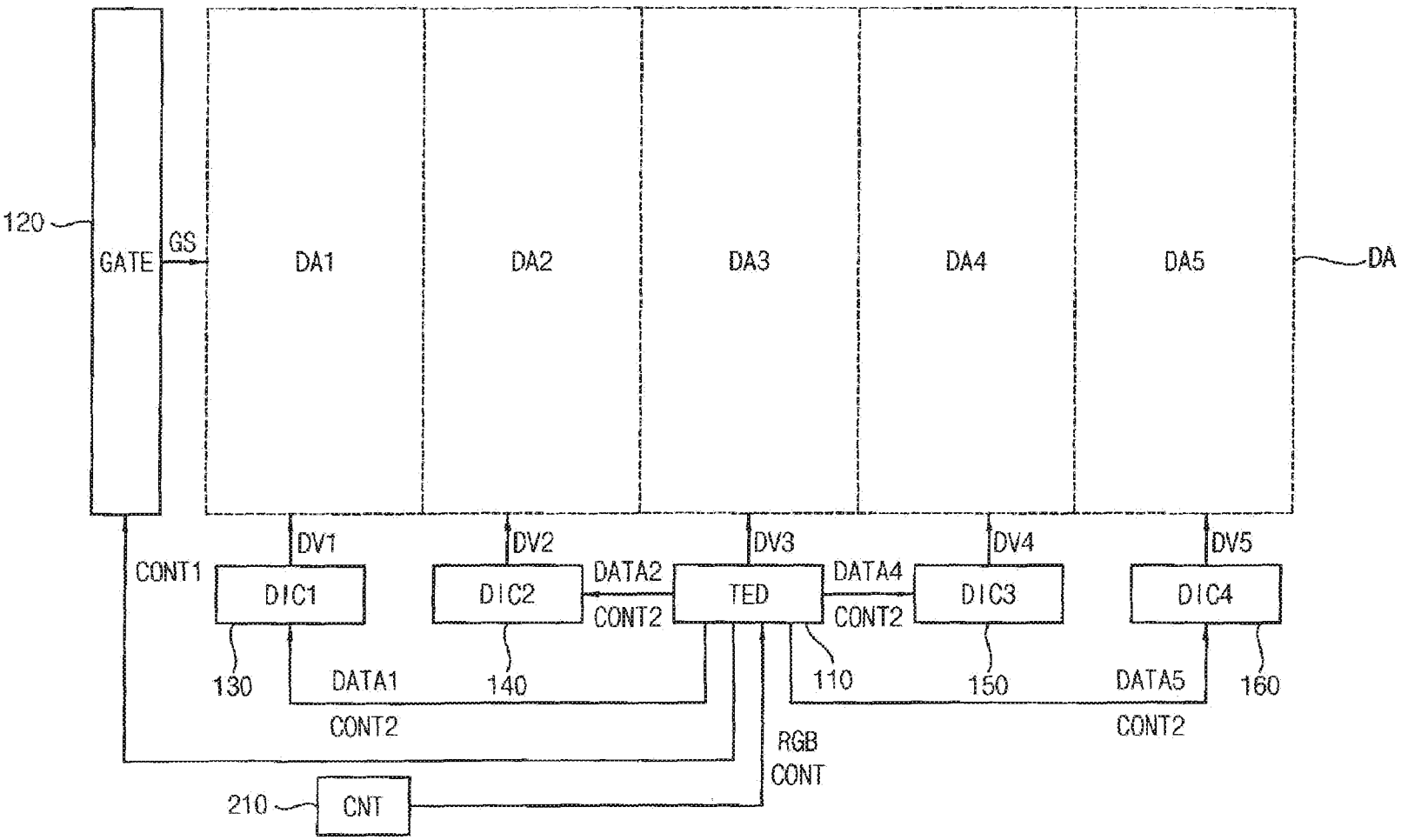
FIG. 8 is a block diagram illustrating the display apparatus of FIG. 7.

FIG. 7 is a plan view illustrating a display apparatus according to an exemplary embodiment of the present invention. FIG. 8 is a block diagram illustrating the display apparatus of FIG. 7.

The display apparatus of FIG. 7 and FIG. 8 may be substantially similar to or the same as the display apparatus of FIG. 1, FIG. 2, and FIG. 3 except that the display panel 100C includes four data drivers. Thus, the same reference numerals will be used to refer to the same or like parts as those described in FIG. 1, FIG. 2, and FIG. 3 and any repetitive explanation concerning the above elements may be omitted.

Referring to FIG. 3, FIG. 7, and FIG. 8, the display apparatus includes the display apparatus includes a display panel 100C and a flexible printed circuit board 200.

The display panel 100C includes a timing controller embedded data driver 110 (TED), a gate driver 120 (GATE), a first data driver 130 (DIC1), a second data driver 140 (DIC2), a third data driver 150 (DIC3), and a fourth data driver 160 (DIC4). The timing controller embedded data driver 110, the gate driver 120, the first data driver 130, the second data driver 140, the third data driver 150, and the fourth data driver 160 may be formed or disposed in the peripheral area PA of the display panel 100.

The flexible printed circuit board 200 includes a connector 210 and a voltage generator 220. The flexible printed circuit board 200 may further include a gamma reference voltage generator 230.

The timing controller embedded data driver 110 includes an image processing part 111, an internal data driving part 112, a signal generating part 113, and a level shifter 114.

The image processing part 111 may receive the input image data RGB from the connector 210. The input image data RGB may include grayscale data corresponding to some or all of the first display area DA1, the second display area DA2, the third display area DA3, the fourth display area DA4, and the fifth display area DA5 of the display panel 100.

The image processing part 111 rearranges the input image data RGB to generate a data signal to correspond to a structure of the display panel 100C. In addition, the image processing part 111 may divide the data signal to correspond to the first display area DA1, the second display area DA2, the third display area DA3, the fourth display area DA4 and the fifth display area DA5.

The image processing part 111 may generate a first data signal DATA1 corresponding to the first display area DA1 based on the input image data RGB, and may output the first data signal DATA1 to the first data driver 130.

The image processing part 111 may generate a second data signal DATA2 corresponding to the second display area DA2 based on the input image data RGB, and may output the second data signal DATA2 to the second data driver 140.

The image processing part 111 may generate a third data signal DATA3 corresponding to the third display area DA3 based on the input image data RGB, and may output the third data signal DATA3 to the internal data driving part 112.

The image processing part 111 may generate a fourth data signal DATA4 corresponding to the fourth display area DA4 based on the input image data RGB, and may output the fourth data signal DATA4 to the third data driver 150.

The image processing part 111 may generate a fifth data signal DATA5 corresponding to the fifth display area DA5 based on the input image data RGB, and may output the fifth data signal DATA5 to the fourth data driver 160.

The internal data driving part 112 may receive the third data signal DATA3 from the image processing part 111. The internal data driving part 112 may receive a data control signal CONT2 from the signal generating part 113. The internal data driving part 112 may generate a third data voltage DV3 based on the third data signal DATA3 in response to the data control signal CONT2. The internal data driving part 112 may output the third data voltage DV3 to the third display area DA3.

The first data driver 130 may receive the first data signal DATA1 from the image processing part 111. The first data driver 130 may receive the data control signal CONT2 from the signal generating part 113. The first data driver 130 may generate a first data voltage DV1 based on the first data signal DATA1 in response to the data control signal CONT2. The first data driver 130 may output the first data voltage DV1 to the first display area DA1.

The second data driver 140 may receive the second data signal DATA2 from the image processing part 111. The second data driver 140 may receive the data control signal CONT2 from the signal generating part 113. The second data driver 140 may generate a second data voltage DV2 based on the second data signal DATA2 in response to the data control signal CONT2. The second data driver 140 may output or transmit the second data voltage DV2 to the second display area DA2.

The third data driver 150 may receive the fourth data signal DATA4 from the image processing part 111. The third data driver 150 may receive the data control signal CONT2 from the signal generating part 113. The third data driver 150 may generate a fourth data voltage DV4 based on the fourth data signal DATA4 in response to the data control signal CONT2. The third data driver 150 may output the fourth data voltage DV4 to the fourth display area DA4.

The fourth data driver 160 may receive the fifth data signal DATA5 from the image processing part 111. The fourth data driver 160 may receive the data control signal CONT2 from the signal generating part 113. The fourth data driver 160 may generate a fifth data voltage DV5 based on the fifth data signal DATA5 in response to the data control signal CONT2. The fourth data driver 160 may output the fifth data voltage DV5 to the fifth display area DA5.

Although the first data signal DATA1 and the fifth data signal DATA5 may be directly transmitted from the timing controller embedded data driver 110 to the first data driver 130 and the fourth data driver 160, aspects of the invention are not limited thereto, such that the first data signal DATA1 and the fifth data signal DATA5 may be transmitted to the first data driver 130 and the fourth data driver 160 via the second data driver 140 and the third data driver 150.

Although the timing controller embedded data driver 110 is described as including the level shifter 114 and the second gate control signal CONT1, which may be directly outputted to the gate driver 120 (see e.g., FIG. 2), aspects of the invention are not limited thereto, such that the second gate control signal CONT1 may be transmitted to the gate driver 120 via the first data driver 130 and the second data driver 140 (see e.g., FIG. 4).

Further, although the timing controller embedded data driver 110 is described as including the level shifter 114 (see e.g., FIG. 3), aspects of the invention are not limited thereto, such that the flexible printed circuit board 200 may include the level shifter (see e.g., FIG. 5).

According to aspects of the invention, the display panel 100C includes the timing controller embedded data driver 110, which may function or operate as both the timing controller and the data driver, such that a printed circuit board to mount the timing controller may be omitted. Thus, a thickness of the display apparatus may be decreased.

In addition, the image processing part 111 and the internal data driver 112 may be formed, disposed, or configured in a single chip, such that power consumption for a signal transmission may be decreased in comparison to a signal transmission between the timing controller and an external data driver.

In addition, the data signal corresponding to the first display area DA1, the data signal corresponding to the second display area DA2, the data signal corresponding to the third display area DA3, the data signal corresponding to the fourth display area DA4, and the data signal corresponding to the fifth display area DA5 may be divided in the timing controller embedded data driver 110. Accordingly, a set board may not be required to provide divided input image data for at least one of the first display area DA1, the second display area DA2, the third display area DA3, the fourth display area DA4, and the fifth display area DA5. Thus, compatibility to a normal set board may be guaranteed.

According to aspects of the invention, the display panel may include a timing controller embedded data driver, which may function or operate as both the timing controller and the data driver so that a thickness and a power consumption of the display apparatus may be decreased.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A display panel, comprising:

a timing controller embedded data driver, comprising:

an image processing part configured to receive image data, and to generate a plurality of data signals corresponding to a plurality of respective display areas based on the image data, and an internal data driving part configured to generate a timing controller embedded data driver data voltage based on the data signal corresponding to a display area adjacent the timing controller embedded data driver, and to output the data voltage to the display area adjacent the timing controller embedded data driver;

a plurality of data drivers disposed on both sides of the timing controller embedded data driver, each of the plurality of data drivers configured to receive a respective data signal directly from the timing controller embedded data driver, to generate a respective data voltage based on the respective data signal, and to output the respective data voltage to a respective display area adjacent the respective data driver; and a gate driver disposed adjacent to one of the display areas, wherein the gate driver is configured to output a gate signal to at least one of the display areas, wherein the timing controller embedded data driver is configured to output a gate control signal directly to the gate driver.

2. The display panel of claim 1, wherein the gate driver is integrated on a substrate of the display panel.

3. The display panel of claim 1, wherein the timing controller embedded data driver is configured in a first chip, and the each data driver is configured in a respective chip spaced apart from the first chip.

4. The display panel of claim 3, wherein the first chip and the respective chips are mounted on a substrate of the display panel.

5. A display apparatus, comprising:

a display panel comprising:

a timing controller embedded data driver, comprising:

an image processing part configured to receive image data, and to generate a plurality of data signals corresponding to a plurality of respective display areas based on the image data, and an internal data driving part configured to generate a timing controller embedded data driver data voltage based on the data signal corresponding to a display area adjacent the timing controller embedded data driver, and to output the data voltage to the display area adjacent the timing controller embedded data driver;

a plurality of data drivers disposed on both sides of the timing controller embedded data driver, each of the plurality of data drivers configured to receive a respective data signal directly from the timing controller embedded data driver, to generate a respective data voltage based on the respective data signal, and to output the respective data voltage to a respective display area adjacent the respective data driver; and a flexible printed circuit board connected to the display panel, the flexible printed circuit board comprising:

a connector configured to transmit the input image data to the timing controller embedded data driver;

a voltage generator configured to provide power voltage to the timing controller embedded data driver and the plurality of data drivers; and a gate driver disposed adjacent to one of the display areas, wherein the gate driver is configured to output a gate signal to at least one of the display areas, wherein the timing controller embedded data driver is configured to output a gate control signal directly to the gate driver.

6. The display apparatus of claim 5, wherein the gate driver is integrated on a substrate of the display panel.

7. The display apparatus of claim 5, wherein the timing controller embedded data driver comprises a signal generating part configured to generate a first gate control signal based on an input control signal, and the flexible printed circuit board further comprises a level shifter configured to adjust a level of the first gate control signal to generate a second gate control signal.

8. The display apparatus of claim 5, wherein the timing controller embedded data driver is configured in a first chip, and each data driver is configured in a respective chip spaced apart from the first chip.

9. The display apparatus of claim 8, wherein the first chip and the respective chips are mounted on a substrate of the display panel.

10. A display panel, comprising:

a timing controller comprising a timing controller embedded data driver disposed on the display panel without a printed circuit board (PCB), the timing controller comprising:

an image processing part configured to receive image data, and to generate a plurality of data signals corresponding to a plurality of respective display areas based on the image data, and an internal data driving part configured to generate a timing controller embedded data driver data voltage based on the data signal corresponding to a display area adjacent the timing controller embedded data driver, and to output the data voltage to the display area adjacent the timing controller embedded data driver;

a plurality of data drivers configured to receive a respective data signal from the timing controller embedded data driver, to generate a respective data voltage based on the respective data signal, and to output the respective data voltage to a respective display area; and a gate driver disposed adjacent to one of the display areas, wherein the gate driver is configured to output a gate signal to at least one of the display areas, wherein the timing controller embedded data driver is configured to output a gate control signal directly to the gate driver.

* * * * *